US010467954B2

(12) United States Patent
Wang et al.

(10) Patent No.: US 10,467,954 B2
(45) Date of Patent: Nov. 5, 2019

(54) IMAGE DISPLAY METHOD, STORAGE MEDIUM, IMAGE DRIVE DEVICE AND DISPLAY DEVICE

(71) Applicant: BOE TECHNOLOGY GROUP CO., LTD., Beijing (CN)

(72) Inventors: Lirong Wang, Beijing (CN); Fei Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/825,974

(22) Filed: Nov. 29, 2017

(65) Prior Publication Data

US 2018/0357955 A1 Dec. 13, 2018

(30) Foreign Application Priority Data

Jun. 7, 2017 (CN) ..... 2017 1 0424290

(51) Int. Cl.
*G09G 3/32* (2016.01)
*G09G 3/3225* (2016.01)
*G09G 3/20* (2006.01)

(52) U.S. Cl.
CPC ..... *G09G 3/3225* (2013.01); *G09G 3/2092* (2013.01); *G09G 2300/0439* (2013.01); *G09G 2320/0257* (2013.01); *G09G 2320/046* (2013.01); *G09G 2320/103* (2013.01)

(58) Field of Classification Search
CPC ..... G09G 2320/046
See application file for complete search history.

(56) References Cited

U.S. PATENT DOCUMENTS

2004/0252135 A1 12/2004 Ono
2017/0221455 A1* 8/2017 Lee ..... G06T 3/20

FOREIGN PATENT DOCUMENTS

| | | | |
|---|---|---|---|
| CN | 1573860 | A | 2/2005 |
| CN | 1641727 | A | 7/2005 |
| CN | 101777315 | A | 7/2010 |
| CN | 101866610 | A | 10/2010 |
| JP | H08-275195 | A | 10/1996 |

OTHER PUBLICATIONS

Chinese Office Action in Chinese Application No. 201710424290.6, dated Sep. 27, 2018 with English translation.

* cited by examiner

*Primary Examiner* — Joseph R Haley
(74) *Attorney, Agent, or Firm* — Collard & Roe, P.C.

(57) ABSTRACT

An image display method, a storage medium, an image drive device and a display device are disclosed. The image display method, applicable to an image display device, includes: selecting at least a partial area in an image display area as a movable area; allowing the movable area to move M pixel step or steps from an initial position along a first direction; and allowing the movable area to move N pixel step or steps along a second direction. The first direction is intersected with the second direction, M≥1 and N≥1.

20 Claims, 7 Drawing Sheets

IMAGE DISPLAY METHOD, STORAGE MEDIUM, IMAGE DRIVE DEVICE AND DISPLAY DEVICE

CROSS REFERENCE TO RELATED APPLICATIONS

Applicant claims priority under 35 U.S.C. § 119 of Chinese Application No. 201710424290.6 filed on Jun. 7, 2017, the disclosure of which is incorporated by reference.

The present application claims priority to the Chinese patent application No. 201710424290.6, filed Jun. 7, 2017, the entire disclosure of which is incorporated herein by reference as part of the present application.

TECHNICAL FIELD

Embodiments of the present disclosure relate to an image display method, a storage medium, an image drive device and a display device for alleviating or avoiding afterimage.

BACKGROUND SUMMARY

Organic light-emitting diode (OLED) display is a kind of all solid state active display. OLED displays are regarded as newly emerging next-generation displays due to the characteristics such as high brightness, high contrast, ultrathin and ultralight profile, low power consumption, no limitation of visual angle, wide working temperature range, etc. One of the problems that OLED display technology faces until today is afterimage display.

When a display has being display the same image for a long time, after the process of switching the currently displayed image into a next image, the currently displayed image will be partially retained in the next image. This phenomenon is referred to as afterimage (screen burn-in). The afterimage phenomenon of an OLED display is relevant to the drift of the threshold voltage (Vth) for driving thin-film transistors (TFTs) of OLED pixels. In different display periods, different display grayscales will produce different TFT drain currents, so the drift of the TFT threshold voltage (Vth) of the OLED pixels may be caused in different degrees.

For instance, FIG. 1A is a schematic diagram of an image 1 that is displayed by the display; FIG. 1B is a schematic diagram of an image 2 that is required to be displayed by the display; and FIG. 1C is a schematic diagram of the image 2 actually displayed by the display. After the display has being display the image 1, e.g., a black and white checkerboard image, for a long time, when the image displayed by the display is switched into a new image 2, e.g., an image with the grayscale of 127 as illustrated in FIG. 1B, the checkerboard image of the image 1 as illustrated in FIG. 1A is still partially retained as illustrated in FIG. 1C.

When the display loads and displays one image continuously for a long time, afterimage may be caused. In the case of slight afterimage, generally the afterimage gradually fades away. But if a still image is displayed for too long time or accumulated in a long term, the afterimage phenomenon becomes very severe, so the afterimage will result in permanent and irreversible damage to the display.

SUMMARY

An embodiment of the present disclosure provides a image display method, applicable to an image display device, comprising: selecting at least a partial area in an image display area as a movable area; allowing the movable area to move M pixel step or steps from an initial position along a first direction; and allowing the movable area to move N pixel step or steps along a second direction, wherein the first direction is intersected with the second direction, $M \geqslant 1$ and $N \geqslant 1$.

For example, in the image display method according to the embodiment, allowing of the movable area to move M pixel step or steps from the initial position along the first direction comprises repeating a following operation at least one time: allowing the movable area to move J pixel step or steps towards a positive orientation of the first direction, and allowing the movable area to move K pixel step or steps towards a negative orientation of the first direction, in which $J>K \geqslant 1$.

For example, in the image display method according to the embodiment, allowing of the movable area to move N pixel step or steps along the second direction comprises repeating a following operation at least one time: allowing the movable area to move P pixel step or steps towards a positive orientation of the second direction, and allowing the movable area to move Q pixel step or steps towards a negative orientation of the second direction.

For example, the image display method according to the embodiment, after allowing of the movable area to move N pixel step or steps along the second direction, further comprises: allowing the movable area to move L pixel step or steps along a third direction, in which the third direction is different from the second direction and is same as the first direction or different from the first direction, and $L \geqslant 1$.

For example, in the image display method according to the embodiment, the movable area is returned to the initial position after movement.

For example, in the image display method according to the embodiment, a shape of a moving track of the movable area comprises triangle, quadrangle, hexagon or octagon.

For example, in the image display method according to the embodiment, a shape of a moving track of the movable area comprises an unclosed spire.

For example, in the image display method according to the embodiment, a spiral direction of the unclosed spire is to diffuse from inside to outside or shrink from outside to inside.

For example, in the image display method according to the embodiment, the image display area is entirely selected as the movable area.

For example, in the image display method according to the embodiment, the image display area displays a still image.

Another embodiment of the present disclosure provides a nonvolatile storage medium, computer instructions applicable to be executed by a processor are stored on the nonvolatile storage medium, and the method according to any of the above examples is implemented when the computer instructions are executed by the processor.

Still another embodiment of the present disclosure provides an image drive device, comprising: a processor; and a nonvolatile storage medium, in which computer instructions applicable to be executed by a processor are stored on the storage medium; and the method according to any of the above examples is implemented when the computer instructions are executed by the processor.

Further another embodiment of the present disclosure provides a display device, comprising the above-mentioned image drive device.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly.

At least an embodiment of the present disclosure provides an image display method, comprising: selecting at least a partial area in an image display area as a movable area; allowing the movable area to move M pixel step or steps from an initial position along a first direction; and allowing the movable area to move N pixel step or steps along a second direction. Here the first direction is intersected with the second direction, $M \geqslant 1$ and $N \geqslant 1$. At least an embodiment of the present disclosure further provides a storage medium, an image drive device and a display device corresponding to the image display method.

The image display method of the embodiment can avoid the afterimage phenomenon of the display and hence avoid the damage to the display caused by the afterimage and prolong the service life of the display. Description will be given below with reference to several embodiments.

Figure 1A:
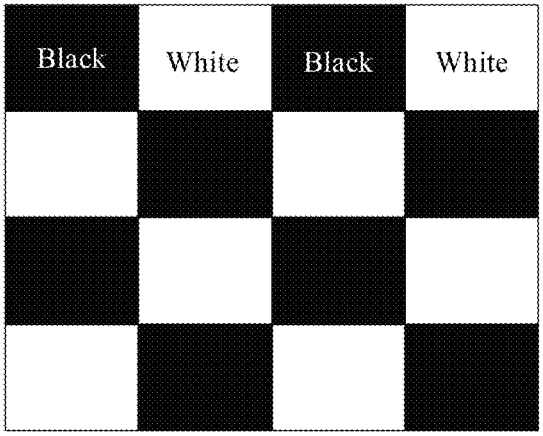
FIG. 1A is a schematic diagram of an image 1 that is displayed by a display.
Figure 1B:
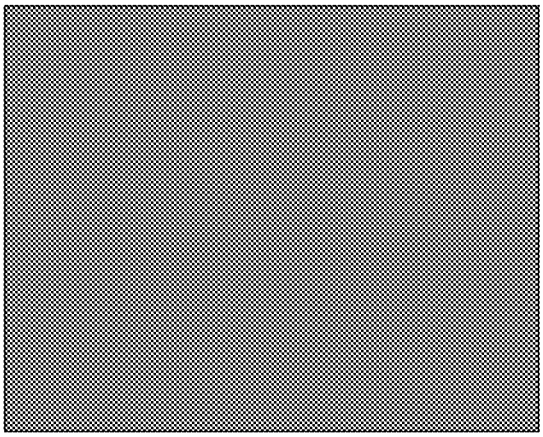
FIG. 1B is a schematic diagram of an image 2 that is required to be displayed by the display.
Figure 1C:
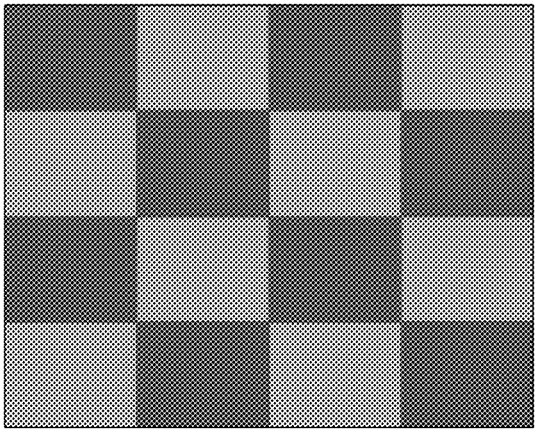
FIG. 1C is a schematic diagram of the image 2 actually displayed by the display.
Figure 2:
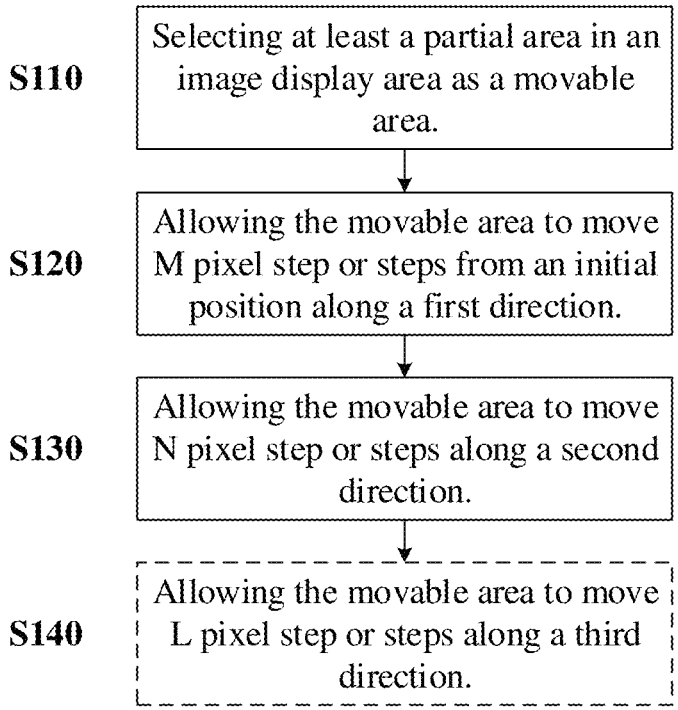
FIG. 2 is a flow diagram of an image display method provided by one example of an embodiment of the present disclosure.

One example of the embodiment provides an image display method, which is applicable to an image display device. As illustrated in FIG. 2, as for an image displayed by the image display device, the image display method comprises the following operations:

S110: selecting at least a partial area in an image display area as a movable area;

S120: allowing the movable area to move M pixel step or steps from an initial position along a first direction; and S130: allowing the movable area to move N pixel step or steps along a second direction. The first direction is intersected with the second direction; M and N are integers, $M \geqslant 1$ and $N \geqslant 1$.

A display screen of the display device can be used for display output. As for the above method, the entire screen area may be taken as a display area, or one part of the display screen may also be taken as the display area as required. The display screen of the display device adopts a sub-pixel array and, for instance, may adopt various resolutions, e.g., 640×480, 1024×768 or 1600×1200. In the embodiment of the present disclosure, the display area may be processed as a whole, and the display area may also be further divided into a plurality of areas. These areas may be regular areas or irregular areas, and some area is selected and processed. In the step S110, at least a partial area in the image display area is selected as the movable area, which may be at different positions on the display screen at different periods in the display operation process.

Figure 3:
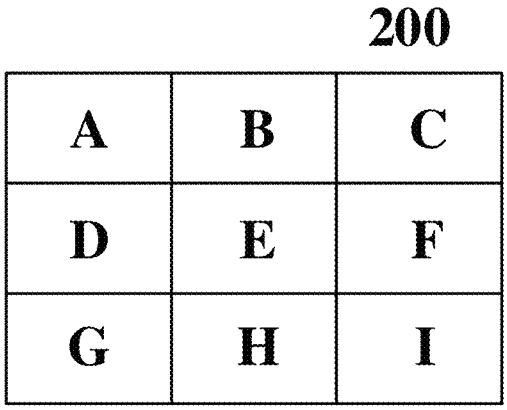
FIG. 3 is a schematic diagram of an image display area of an OLED.

For instance, as illustrated in FIG. 3, an image display area 200 of an OLED display is divided into nine (i.e., 3×3) image display areas which are respectively A, B, C . . . H and I. For instance, when the OLED display stays in the Welcome screen or splash screen, the entire image display area 200 displays a still image. In this case, if the still image is kept unchanged for a long time which exceeds certain time, e.g., 30 minutes, and no operation is performed on the display image, the display screen tends to suffer from the afterimage phenomenon, and then the display can be damaged to some extent. In this case, the entire image display area may be selected as the movable area.

Moreover, for instance, as illustrated in FIG. 3, when the OLED display is switched to an interface of an application software, for instance, a navigation application, in this case the image display areas A, B, C, D and G are used for continuously displaying indicator images or icons of navigation operations, and these image display areas display unchanged still image. The remaining areas E, F, H and I of the display area 200 display navigation map information, and these display areas update the display image in real time according to the received position information, namely these areas display dynamic images. In this case, in order to avoid afterimage, one or all of the areas A, B, C, D and G may be selected as the movable area operated in the image display method provided by the example.

It should be noted that the embodiment of the present disclosure includes but not limited to the above selection modes of the movable area. For instance, when the entire image display area 200 of the image display device displays the still image, one or more partial areas, e.g., the areas A, B and C, of the image display area 200 can be selected as the movable areas at first; after steps of the image display method are executed, the areas D, E and F are selected as the movable areas; and finally, the areas G H and I are selected as the movable areas, namely time-sharing selection mode is adopted and the steps of the image display method are executed repeatedly. For instance, the movable area in the display image is not limited to the part in a regular shape and may also be the part in an irregular shape. In another embodiment of the present disclosure, the movable area may also be selected based on the content of the current display image, for instance, the background area (generally a still area) of a displayed image or video can be selected as the movable area in the above method.

Figure 4:
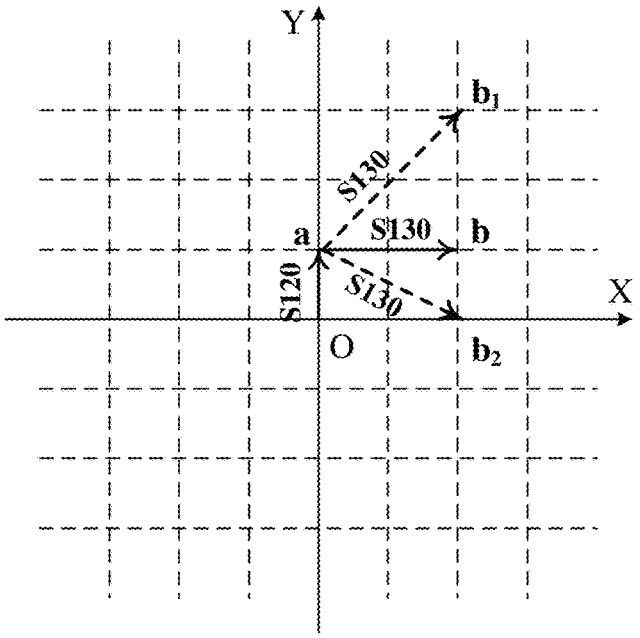
FIG. 4 is a schematic diagram illustrating the moving track of the image display method provided by one example of an embodiment of the present disclosure.

In addition, it should be noted that: in the embodiment of the present disclosure, for instance, as illustrated in FIG. 4, for convenient description of the moving direction, a rectangular coordinate system is drawn; X and Y axes intersect at a point O; and the point O indicates the initial position when the movable area begins to move. In FIG. 4, a plurality of dotted lines parallel to the X and Y axes are drawn for reference; these dotted lines are respectively intersected to divide an area as illustrated in FIG. 4 into a plurality of square areas; points at which the dotted lines are intersected are pixel dots; and the side length of one square is defined as one unit of pixel step. In the description of the movement of the movable area, one sub-pixel in the movable area is mentioned for simple description; other sub-pixels are moved in the same way as this sub-pixel; and the path through which one sub-pixel moves is defined as a moving track. The following embodiments are the same as the embodiment in this aspect. In addition, although the description is given with reference to the accompanying drawings by taking a standard matrix pixel array as an example, it should be understood by those skilled in the art that the sub-pixels may also be arranged in other kinds of array, for instance, a triangular or delta array (Δ), namely three adjacent sub-pixels are respectively distributed at, for instance, three vertexes of a regular triangle.

In the step S120, for instance, as illustrated in FIG. 4, in the display process, in an image being displayed, the movable area is allowed to move M pixel step or steps from the initial position along the first direction, and $M \geqslant 1$.

For instance, as illustrated in FIG. 4, the movable area is allowed to move one pixel step in the direction of the Y axis beginning from the initial position, namely the point O, to the dot a. That is to say, the direction of the Y axis is the first direction, and M=1. Of course, the first direction may also be another direction, for instance, the direction of the X axis. In the step S120, the amount M of the moved pixel step may also in be other values, for instance, M=2. No limitation will be given here in the embodiment of the present disclosure. The following embodiments are the same.

In the step S130, for instance, as illustrated in FIG. 4, in the display process, in the image being displayed, the movable area is allowed to move N pixel step or steps along the second direction, and $N \geqslant 1$. The second direction and the first direction are different from each other, for instance, are intersected with each other.

For instance, as illustrated in FIG. 4, the movable area is allowed to move 2 pixel steps along one direction parallel to the X axis from the dot a to a dot b. That is to say, the direction of ab (i.e., the direction from the dot a to the dot b, and in the following the similar expression has the similar meaning) is the second direction, and N=2. Of course, the second direction may also be other directions. For instance, as illustrated in FIG. 4, the second direction may also be the direction of ab1 or ab2, which is shown by a dotted line with an arrow in the figure. In the step S130, the amount N of the moved pixel step may also be other values, for instance, N=1. No limitation will be given here in the embodiment of the present disclosure. The following embodiments are the same.

It should be noted that: when the moving direction is not parallel to the X axis or the Y axis, for instance, the moved step or steps may be defined as the bigger pixel step or steps of the moving track projected on the X and Y axes. For instance, as illustrated in FIG. 4, the projections of the moving track as shown by ab2 on the X and Y axes are respectively 2 pixel steps and 1 pixel step, so the value of the pixel steps of the track ab2 moving along the second direction is 2. In addition, it should be noted that the moving direction in the embodiment of the present disclosure is not limited to a vector. For instance, the first direction of the moving track Oa includes two directions which are respectively the positive orientation of the first direction and the negative orientation of the first direction, namely the movement along the positive orientation of the first direction or the negative orientation of the first direction is the movement along the first direction.

In the embodiment, at least a partial area in the image display area is selected as the movable area at first. For instance, the partial area is a part of the display area or the whole of the display area of the displayed still image. Subsequently, the movable area is allowed to move one pixel step or several pixel steps towards the first direction and move one pixel step or several pixel steps towards the second direction after predetermined time. When the above operations are performed on the movable area, the afterimage of the display can be alleviated or avoided, so the damage cased by the afterimage to the display can be avoided, and hence the service life of the display can be prolonged. The predetermined time, for instance, may be selected as 5 seconds, 10 seconds, 15 seconds, etc. The predetermined time and the pixel step(s) may be selected as required, as long as at least the image display effect will not be disadvantageously affected. For instance, when the movable area is moved, in order to not affect other areas, the display content in edge portions of the movable area may be processed. For instance, the part of the display image that is moved out of the movable area are cut off, or blank rows or columns appearing on the opposite side due to the movement of the display image are complemented by copying adjacent rows or adjacent columns, linear interpolation, or the like. No limitation will be given here in the embodiment of the present disclosure.

Figure 5:
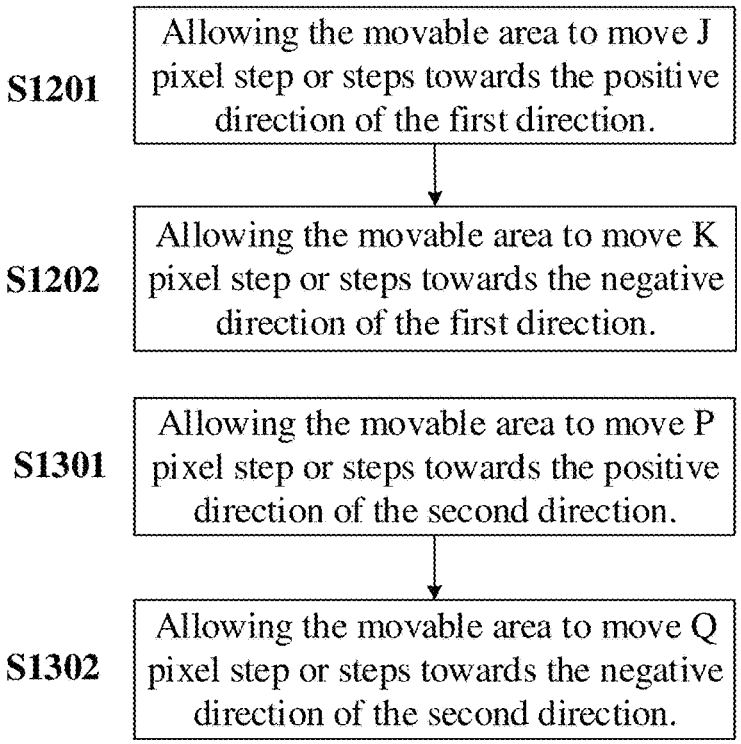
FIG. 5 is a flow diagram of an image display method provided by another example of an embodiment of the present disclosure.

For instance, in another example of the embodiment, as illustrated in FIG. 5, in the step S120, in the display process, in the image being displayed, the process of allowing the movable area to move M pixel step or steps from the initial position along the first direction may include the following operations:

S1201: allowing the movable area to move J pixel step or pixel steps towards the positive orientation of the first direction; and S1202: allowing the movable area to move K pixel step or pixel steps towards the negative orientation of the first direction, and J>K≥1.

Figure 6:
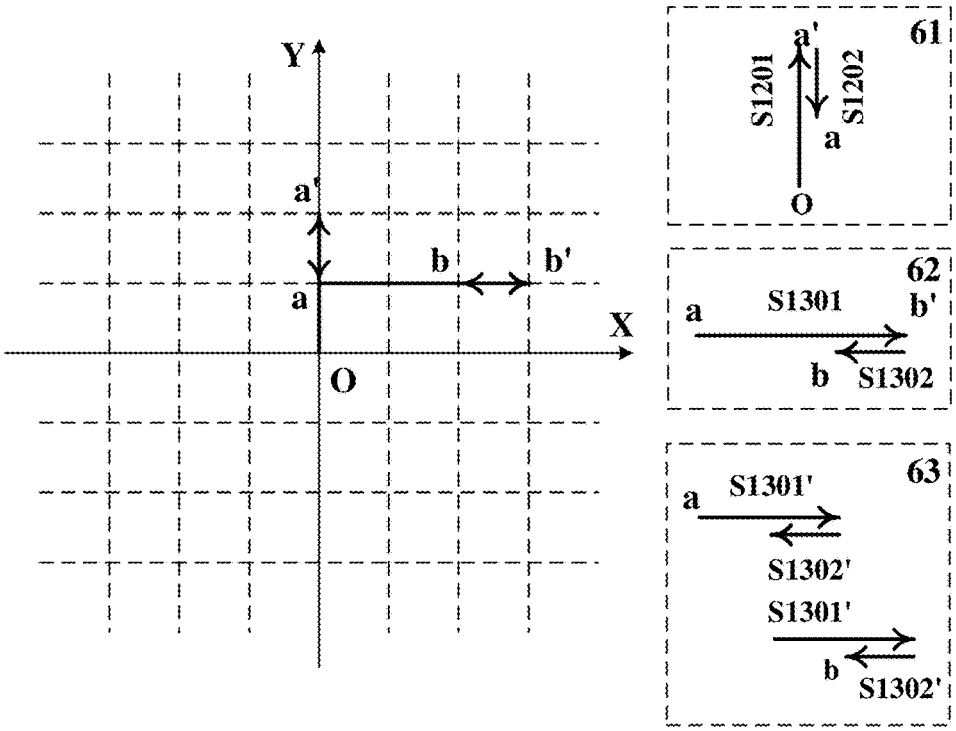
FIG. 6 is a schematic diagram illustrating the moving track of the image display method provided by another example of an embodiment of the present disclosure.

As illustrated in FIG. 6, for the convenience of understanding, the overlapping tracks are shown separately in the right-hand dashed box in FIG. 6. In order to allow the movable area to move one pixel step along the first direction from the initial position, namely the point O, to the dot a, the illustrative process includes (as illustrated in a dashed box 61) the following operations:

S1201: allowing the movable area to move two pixel steps towards the positive orientation of the first direction to a dot a'; and S1202: allowing the movable area to move 1 pixel step towards the negative orientation of the first direction to the dot a, namely J=2 and K=1. Of course, the values of J and K include but not limited the above-mentioned values. For instance, J=3 and K=2.

Moreover, for instance, as illustrated in FIG. 5, in the step S130, in the display process, in the image being displayed, the process of allowing the movable area to move N pixel step or steps along the second direction may include the following operations:

S1301: allowing the movable area to move P pixel step or steps towards the positive orientation of the second direction; and S1302: allowing the movable area to move Q pixel step or steps towards the negative orientation of the second direction, and P>Q≥1.

As illustrated in FIG. 6, in order to allow the movable area to move two pixel steps along the second direction from the dot a to a dot b, the illustrative process includes (as illustrated in a dashed box 62) the following steps:

S1301: allowing the movable area to move 3 pixel steps towards the positive orientation of the second direction from the dot a to a dot b'; and S1302: allowing the movable area to move one pixel step towards the negative orientation of the second direction to the dot b, namely P=3 and Q=1. Of course, the values of P and Q include but not limited the above mentioned values. For instance, P=4 and Q=2.

As for the moving modes in the step S130, the embodiment includes but not limited to the above modes. For instance, the process may also be completed by repeating two following operations (as illustrated in a dashed box 63):

S1301': allowing the movable area to move two pixel steps towards the positive orientation of the second direction from the dot a; and S1302': allowing the movable area to move one pixel step towards the negative orientation of the second direction.

The step S130 may also be implemented by repeating above operations two times. Similarly, the step S120 may also be implemented by the reciprocating movements towards the positive and negative orientations in the same direction for multiple times.

In at least an embodiment of the present disclosure, the moving operation is decomposed into the movement of some pixel steps towards the positive orientation and also the movement of some pixel steps towards the negative orientation. By adoption of this means to realize the movement along a certain direction, the visual position deviation caused during movement can be reduced or alleviated.

One example of at least an embodiment of the present disclosure provides an image display method. As illustrated in FIG. 2, the difference from the above embodiment is that the image display method provided by the example further comprises the following operation(s):

S140: allowing the movable area to move L pixel step or steps along a third direction. The third direction is different from the second direction but the same as the first direction or different from the first direction, and L≥1.

Figure 7:
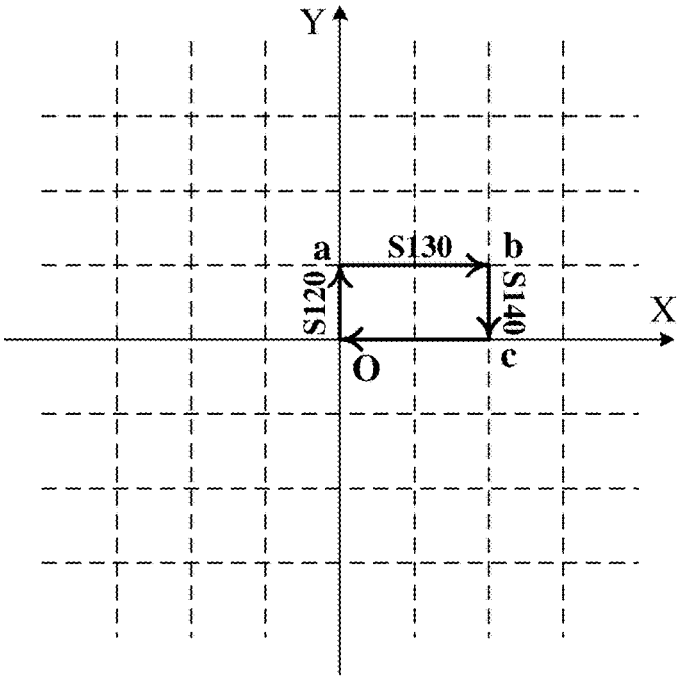
FIG. 7 is a schematic diagram illustrating the moving track of an image display method provided by another embodiment of the present disclosure.

For instance, as illustrated in FIG. 7, the movable area is moved to the dot b after the steps S120 and S130 and then moved to a dot c from the dot b after the step S140. That is to say, the direction of be (i.e., the direction from the dot b to the dot c) is the third direction, and L=1. In the example, the third direction is different from the second direction but the same as the first direction. The embodiment includes but not limited to the above example. For instance, the third direction may also be different from the first direction.

For instance, as illustrated in FIG. 7, the moving operation may further include: allowing the movable area to move from the dot c to the point O. The direction of cO is the same as the second direction but different from the third direction. After the above moving operations, the movable area returns to the initial position, namely the point O. The shape of the moving track is a closed rectangle.

Figure 8:
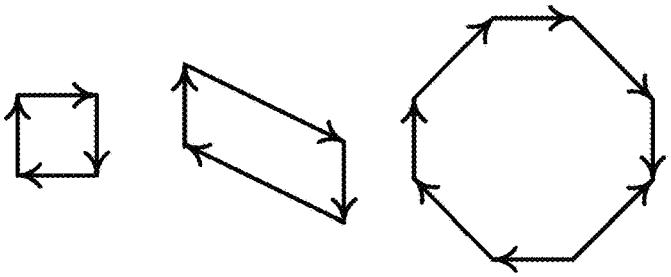
FIG. 8 is a schematic diagram illustrating the case that the moving track is in a closed shape.

It should be noted that the moving track of the movable area may also be in other closed shapes. For instance, as illustrated in FIG. 8, the closed shape includes polygon but not limited to triangle, quadrangle, hexagon, octagon, etc.

Figure 9:
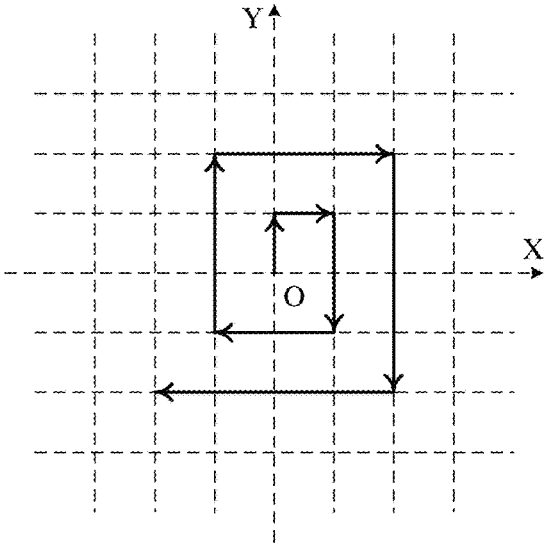
FIG. 9 is a schematic diagram illustrating the case that the moving track is in a spiral shape that is diffused clockwise.
Figure 10:
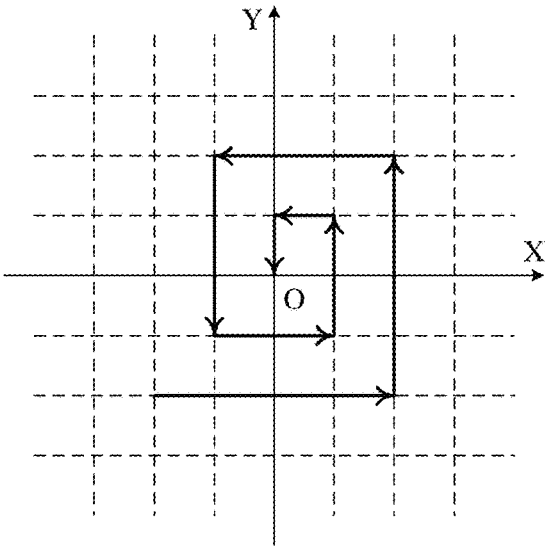
FIG. 10 is a schematic diagram illustrating the case that the moving track is in a spiral shape that is shrunk counterclockwise.

For instance, in another example of the embodiment, as illustrated in FIGS. 9 and 10, the shape of the moving track of the movable area may also be in an unclosed spire. For instance, the spiral shape diffused or expanded from the inside to the outside is shown in FIG. 9, and the moving track mode may be referred to as "clockwise diffusion"; and the spiral shape shrunk from the outside to the inside is shown in FIG. 10, and the moving track mode may be referred to as "counterclockwise shrinkage". It should be noted that the two moving tracks as illustrated in FIGS. 9 and 10 may be cooperated and executed. For example, the moving track mode, namely outward diffusion, as illustrated in FIG. 9 is executed at first at the beginning, and then the moving track mode, namely inward shrinkage, as illustrated in FIG. 10 is executed, so that the movable area can return to the origin O.

For instance, the moving track may be: diffused for several circles at first, for instance, 4 circles, and then shrunk for 4 circles, repeated for multiple times. Moreover, for instance, the moving track may be: diffused for one circle at first and then shrunk for one circle, repeated for multiple times. Furthermore, for instance, the moving track may be: diffused for two circles at first and then shrunk for one circle, repeated for multiple times.

It should be noted that: in the embodiment of the present disclosure, the time interval of the movement of one pixel step can be fixed, e.g., 15 seconds. The time interval cannot be too short, so as to avoid the visual deviation during movement.

In the embodiment of the present disclosure, the movable area can return to the initial position after movement, and the shape of the moving track is in a closed shape. Or the shape of the moving track of the movable area is an unclosed spire, and the movement is around the initial position. By adoption of this means, the afterimage can be avoided or alleviated, and the visual position deviation caused during movement can be reduced.

Figure 11:
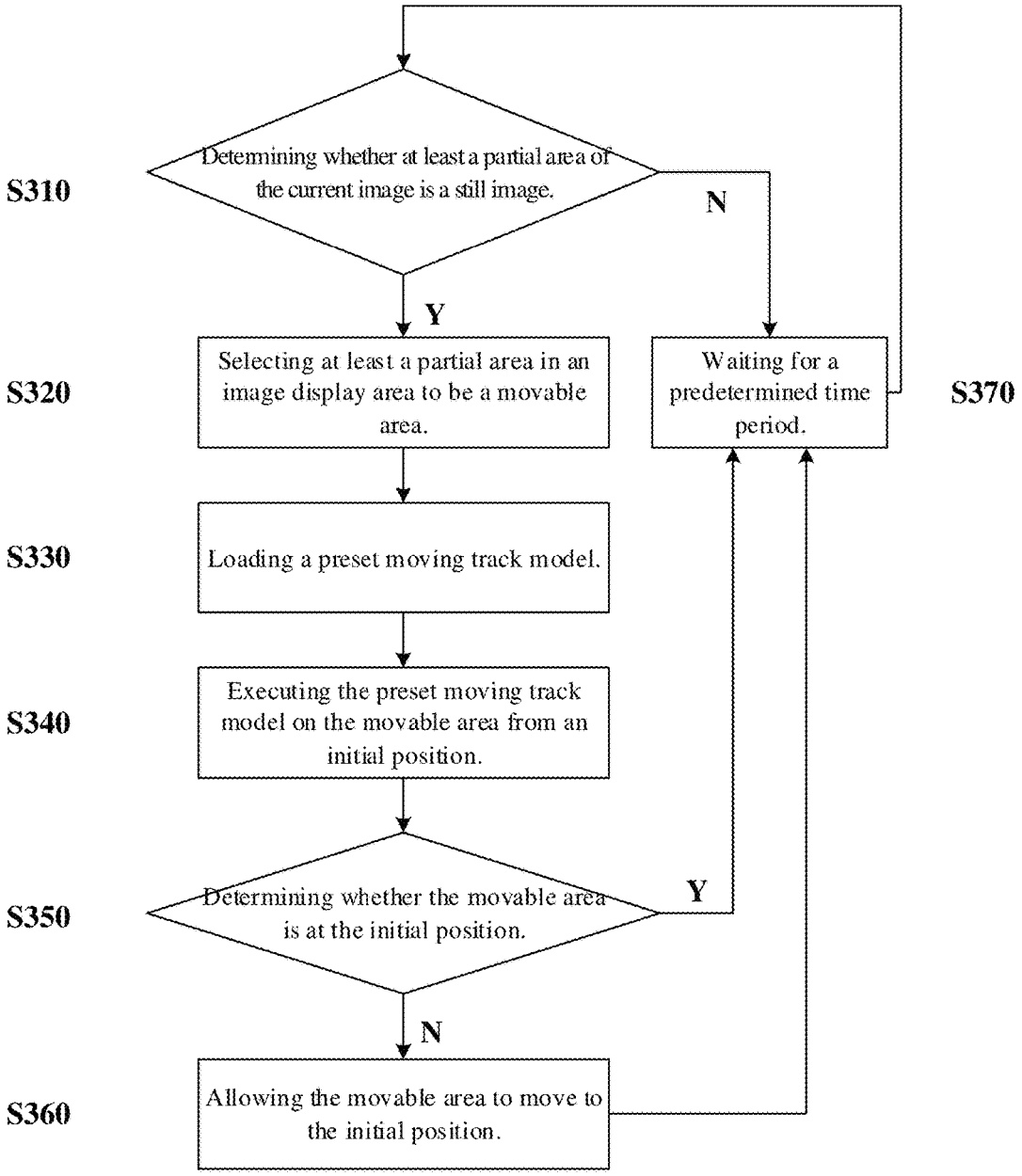
FIG. 11 is a flow diagram of an image display method provided by another embodiment of the present disclosure.

Another embodiment of the present disclosure provides an image display method. As illustrated in FIG. 11, the image display method comprises:

S310: determining whether at least a partial area of the current image is a still image;

S320: selecting at least a partial area in an image display area to be a movable area;

S330: loading a preset moving track model;

S340: executing the preset moving track model on the movable area from an initial position;

S350: determining whether the movable area is at the initial position;

S360: allowing the movable area to move to the initial position; and

S370: waiting for a predetermined time period.

Detailed description will be given below to the operations of the method as illustrated in FIG. 11.

In the step S310, in the display process, as for an image being displayed, whether at least a partial area of the current image is a still image is determined.

For instance, as illustrated in FIG. 11, if the result shows that the currently displayed image includes a still portion, the step S320 is subsequently executed; and if the result shows that the currently displayed image does include any still portion, the step S370 is subsequently executed. In one example, the step of determining whether at least a partial area of the current image is a still image may include the following operations:

Firstly, periodically acquiring frame data of the image or video to be displayed on the screen of a display in the working process of the display. For instance, the period of acquiring the frame data may be 3 seconds, 5 seconds, or the like. The period may be an empirical value. The specific value of the period may be flexibly changed according to actual demands No limitation will be given here. In addition, the frame data may be low-voltage differential signaling (LVDS) data of the display image transmitted in the mode of LVDS or may also be in the transistor-transistor logic (TTL) data mode, or the like. No limitation will be given here.

Secondly, determining whether the currently acquired frame data and the previously acquired frame data have the same data in at least a partial area of the image display area. If so, the area is determined to be the still image, that is, the image displayed in this area is determined to be still; and if not, the area does not include the still image. It should be understood that if the frame data within a certain area are continuously kept the same, the display image in the area does not change, namely a still image is displayed.

Whether at least a partial area of the current image is displaying a still image is determined by the above operation. If not, the step S370 is subsequently executed. The step S370 is waiting (or stayed) for a predetermined time period. For instance, the waiting time period is 15 seconds. The time period value is an empirical value and may be flexibly changed according to actual demands. No limitation will be given here. In the waiting process, no operation is executed, and the step S310 is subsequently executed after the step S370 is executed. If so, the step S320 is subsequently executed.

In the step S320, at least a partial area in the image display area is selected as the movable area. That is to say, at least the partial area in the area which is determined as being displaying the still image in the step S310 is selected as the movable area. The specific method, for instance, may refer to the description on the step S110 in the first embodiment. No further description will be given here.

In the step S330, a preset moving track model is loaded.

For instance, the moving track in any one of the first embodiment and the second embodiment is stored as a data model and stored in a model library, and the user only needs to load a preset moving track model when required. For instance, various moving track models may be prepared in advance and may be randomly selected when loaded. Moreover, for instance, the moving track model is set in a manual selection mode when loaded, namely the moving track of the movable area may be different when the image display method is executed each time. Of course, the tracks may also be entirely or partially the same as each other. No limitation will be given here in the embodiment of the present disclosure.

In the step S340, the preset moving track model is executed on the movable area from the initial position.

For instance, a track model, in which the shape of the moving track as illustrated in FIG. 7 is a closed rectangle, is loaded in the step S330. In the step S340, the movable area returns to the initial position, namely the point O, after passing through the paths Oa, ab, bc, and cO. The specific method, for instance, may refer to relevant description in the second embodiment. No further description will be given here. The step S350 is subsequently executed after the step S340 is executed.

In the step S350, whether the movable area is at the initial position is determined. If the movable area is not at the initial position, the step S360 is subsequently executed; and if the movable area is at the initial position, the step S370 is subsequently executed. The step S310 is subsequently executed after waiting for a predetermined time period.

In the step S360, the movable area is allowed to move to the initial position. In the step S350, if the determination result is "no," it is indicated that the movable area does not return to the initial position after movement, so in the step S360, the movable area is allowed to move back to the initial position.

It should be noted that: as illustrated in FIG. 11, in the process of implementing the image display method provided by the embodiment, the step S370 may be subsequently executed after the step S310, S350 or S360. The step S370 is waiting for a predetermined time period. The waiting time period may be the same for different conditions. For instance, the waiting time period is 15 seconds. The time period value is an empirical value and may be flexibly changed according to actual demands. Of course, the waiting time may also be different for different conditions. For instance, when the step S370 is subsequently executed after the step S310, the waiting time period is 10 seconds. When the step S370 is subsequently executed after the step S350, the waiting time period is 15 seconds. No limitation will be given here in the embodiment.

In the embodiment, before the movable area is selected, whether there is a still image (portion) in the current image display area is determined. If the result is yes, the subsequent steps are executed; and if the result is no, the waiting step is executed. After the preset moving track model is executed on the movable area, whether the movable area is at the initial position is determined. If the result is yes, the waiting step is executed; and if the result is no, the movable area is allowed to the move back to the initial position, and then the waiting step is executed.

The image display method provided by the embodiment can be selectively started for the case that the display displays a still image. On one hand, the afterimage of the display can be alleviated or avoided, so the damage of the afterimage to the display can be alleviated or avoided, and hence the service life of the display can be prolonged. On the other hand, the power consumption can be reduced.

It should be noted that the image display method provided by the embodiment of the present disclosure may be applicable to a thin-film transistor liquid crystal display (TFT-LCD) and may also be applicable to an OLED display, a plasma display panel (PDP), an e-paper display, etc. No limitation will be given here in the present disclosure.

In addition, it should be noted that the image display method provided by the embodiment is illustrated as for the still image, but the present disclosure is not limited thereto. The image display method may also be implemented as for a dynamic image, and the afterimage of the display can be also alleviated or avoided. Thus, the damage of the afterimage to the display can be alleviated or avoided, and then the service life of the display can be prolonged. The following embodiments are the same.

At least an embodiment of the present disclosure provides a storage medium. Computer instructions (codes) applicable to be executed by a processor are stored on the storage medium. The foregoing image display method provided by any embodiment of the present disclosure is implemented when the computer instructions are executed by the processor.

The storage medium may include various forms of computer-readable storage media, for instance, volatile memories and/or nonvolatile memories, for instance, may be a semiconductor storage medium, a magnetic storage medium, an optical storage medium, etc. The volatile memory, for instance, may include random access memory (RAM) and/or cache memory (cache). The nonvolatile memory, for instance, may include read-only memory (ROM), hard disc, flash memory, etc. One or more computer program instructions may be stored in the storage medium, and the processor may execute the program instructions, so as to implement the foregoing image display method provided by at least an embodiment of the present disclosure. The storage medium may also store various data, for instance, the above moving track model data. When the moving track model needs to be loaded, the moving track model is directly called from the storage medium.

The processor may be a central processing unit (CPU) or any processing unit or a processing circuit in other forms having data processing capability and/or instruction execution capability. For instance, the processor may be a computer CPU disposed outside a display panel and adapted or configured for controlling image display. Moreover, for instance, the processor may be a micro-control unit (MCU) of a timing controller (TCON) in an image drive device of a display.

In the embodiment, any foregoing image display method provided by the embodiment of the present disclosure may be implemented by executing the computer programs stored in the storage medium and loading the moving track model stored in the storage medium, so as to avoid the afterimage of the display. Thus, the damage of the afterimage to the display can be alleviated or avoided, and hence the service life of the display can be prolonged.

Figure 12:
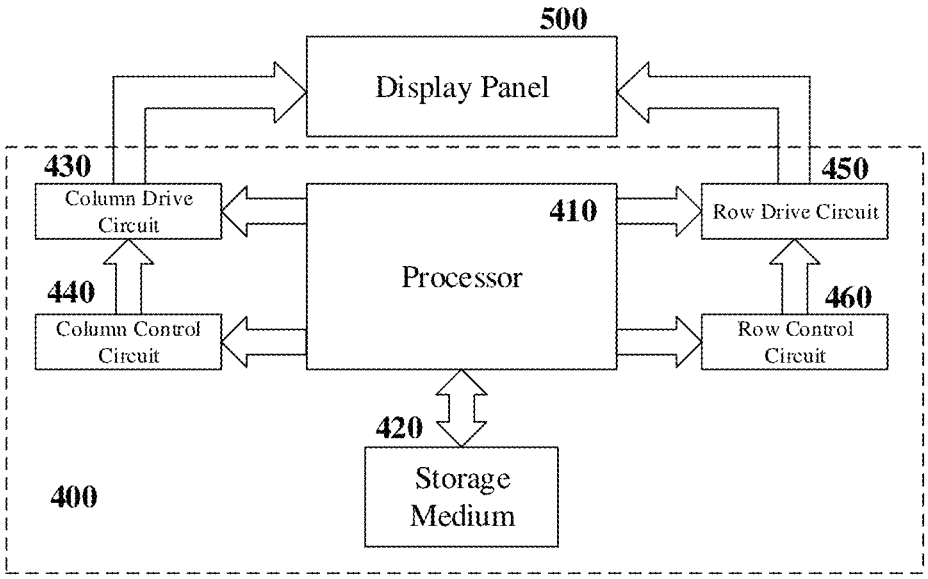
FIG. 12 is a schematic block diagram of a display device provided by an embodiment of the present disclosure.

At least an embodiment of the present disclosure provides an image drive device, which is applicable to drive a display to realize image display. As illustrated in FIG. 12, a dashed box indicates an image drive device 400. The image drive device 400 comprises a processor 410 and a storage medium 420 (e.g., nonvolatile memory). Computer programs applicable to be executed by the processor 410 are stored in the storage medium 420. When the computer programs are executed by the processor 410, any foregoing image display method provided by the embodiment of the present disclosure is implemented.

The processor may be a CPU or any processing unit in other forms having data processing capability and/or instruction execution capability. For instance, the processor may be a computer CPU disposed outside a display panel and used for controlling image display. Moreover, for instance, the processor may be an MCU of a TCON in the display.

Similarly, the storage medium may include various forms of computer-readable storage media, for instance, volatile memories and/or nonvolatile memories, for instance, may be a semiconductor storage medium, a magnetic storage medium, an optical storage medium, etc. The volatile memory, for instance, may include an RAM and/or a cache. The nonvolatile memory, for instance, may include an ROM, a hard disc, a flash memory, etc. One or more computer program instructions may be stored in the storage medium, and the processor may execute the program instructions, so as to implement the foregoing image display method provided by the embodiment of the present disclosure. The storage medium may also store various data, for instance, the above moving track model data. When the moving track model must be loaded, the moving track model is directly called from the storage medium.

The image drive device is a device used for controlling and driving an image required to be displayed by the display. For instance, as illustrated in FIG. 12, the image drive device may further comprise a column drive circuit 430, a column control circuit 440, a row drive circuit 450 and a row control circuit 460. It should be noted that not all the components of the image drive device are given for the purpose of clear description only. In order to realize necessary functions of the image drive device, other components not shown may be improved and set by those skilled in the art according to specific demands No limitation will be given here in the present disclosure.

For instance, as illustrated in FIG. 12, the storage medium 420 stores computer instructions corresponding to any foregoing image display method provided by the embodiment of the present disclosure and the above moving track model data. When required, the processor 410 executes the computer programs and calls the moving track model data, so as to output various control signals and data signals and then control the column drive circuit 430, the column control circuit 440, the row drive circuit 450 and the row control circuit 460, and finally control the image display of the display.

The foregoing image display method provided by the embodiment of the present disclosure can alleviate or avoid the afterimage of the display, so the image drive device provided by the embodiment can also alleviate or avoid the afterimage of the display. Thus, the damage of the afterimage to the display can be avoided, and hence the service life of the display can be prolonged.

At least an embodiment of the present disclosure provides a display device, which, as illustrated in FIG. 12, comprises the image drive device 400 provided by the fifth embodiment and a display panel 500. It should be noted that not all the components of the display device are provided for clear description. In order to realize necessary functions of the display device, other components not shown in the drawing may be provided and set by those skilled in the art according to specific demands No limitation will be given here in the present disclosure. For instance, the display device comprises a receiver used for receiving image data and a decoder used for decoding the image data. The receiver, for instance, may be a modem which is used for data transmission by wired or wireless means. The decoder may be implemented by hardware, software or firmware, for instance, image data of one format is switched into image data of another format.

The image drive device 400 processes the received and decoded image data. The image data, for instance, include a two-dimensional (2D) array corresponding to the display screen. For instance, each array unit corresponds to one sub-pixel on the display screen. Thus, the 2D array may be mapped to be the image display area. The processing of the 2D array corresponds to the processing of the image display area. When the processed image data are sent to the display device and displayed on the display screen, the image displayed by the display device also changes correspondingly, for instance, be entirely or partially moved (e.g., translated).

The display panel 500 in the embodiment may be a TFT-LCD and may also be an OLED display, a PDP, an e-paper display, etc. No limitation will be given here in the present disclosure.

It should be noted that the display device provided by the embodiment may be applicable to most electronic devices requiring image display application such as a TV, a vehicle display or an advertisement screen, especially electronic devices requiring long-term partial or entire display of a still image, e.g., an outdoor advertisement screen.

The technical effects of the display device provided by the embodiment are consistent with the technical effects of the image drive device provided by the above-mentioned embodiment of the present disclosure. That is to say, the afterimage of the display can be alleviated or avoided, so the damage of the afterimage to the display can be alleviated or avoided, and hence the service life of the display can be prolonged.

What are described above is related to the illustrative embodiments of the disclosure only and not limitative to the scope of the disclosure; the scopes of the disclosure are defined by the accompanying claims.

What is claimed is:

1. An image display method, applicable to an image display device, comprising:

selecting at least a partial area in an image display area as a movable area;

allowing the movable area to move M pixel step or steps from an initial position to a first position along a first direction; and allowing the movable area to move N pixel step or steps from the first position to a second position along a second direction, wherein the first direction is intersected with the second direction, M≥1 and N≥1;

allowing of the movable area to move M pixel step or steps from the initial position to the first position along the first direction comprises conducting a following operation at least one time:

allowing the movable area to move J pixel steps from the initial position along a first sub-path towards a positive orientation of the first direction, and allowing the movable area to move K pixel step or steps to the first position along a second sub-path towards a negative orientation of the first direction, wherein J>K≥1, and the first sub-path and the second sub-path partially overlaps.

2. The image display method according to claim 1, wherein an end position of the first sub-path is a start position of the second sub-path.

3. The image display method according to claim 1, wherein allowing of the movable area to move N pixel step or steps from the first position to the second position along the second direction comprises conducting a following operation at least one time:

allowing the movable area to move P pixel steps from the first position to a third position towards a positive orientation of the second direction, and allowing the movable area to move Q pixel step or steps from the third position to the second position towards a negative orientation of the second direction, in which P>Q≥1.

4. The image display method according to claim 1, after allowing of the movable area to move N pixel step or steps along the second direction, further comprising:

allowing the movable area to move L pixel step or steps from the second position along a third direction, in which the third direction is different from the second direction and is same as the first direction, and L≥1.

5. The image display method according to claim 1, wherein the movable area is returned to the initial position after movement.

6. The image display method according to claim 1, wherein a shape of a moving track of the movable area comprises an enclosed triangle, an enclosed quadrangle, an enclosed hexagon or an enclosed octagon.

7. The image display method according to claim 2, wherein the movable area is returned to the initial position after movement.

8. The image display method according to claim 7, wherein a shape of a moving track of the movable area comprises triangle, quadrangle, hexagon or octagon.

9. The image display method according to claim 3, wherein the movable area is returned to the initial position after movement.

10. The image display method according to claim 9, wherein a shape of a moving track of the movable area comprises triangle, quadrangle, hexagon or octagon.

11. The image display method according to claim 4, wherein the movable area is returned to the initial position after movement.

12. The image display method according to claim 11, wherein a shape of a moving track of the movable area comprises triangle, quadrangle, hexagon or octagon.

13. The image display method according to claim 1, wherein a shape of a moving track of the movable area comprises an unclosed spire.

14. The image display method according to claim 13, wherein a spiral direction of the unclosed spire is to diffuse from inside to outside or shrink from outside to inside.

15. The image display method according to claim 1, wherein the image display area is entirely selected as the movable area.

16. The image display method according to claim 1, wherein the image display area displays a still image.

17. A nonvolatile storage medium, computer instructions applicable to be executed by a processor being stored on the nonvolatile storage medium; and when the computer instructions are executed by the processor, a method applicable to an image display device is implemented, and the method comprises:

selecting at least a partial area in an image display area as a movable area;

allowing the movable area to move M pixel step or steps from an initial position to a first position along a first direction; and allowing the movable area to move N pixel step or steps from the first position to a second position along a second direction, wherein the first direction is intersected with the second direction, M≥1 and N≥1;

allowing of the movable area to move M pixel step or steps from the initial position to the first position along the first direction comprises conducting a following operation at least one time:

allowing the movable area to move J pixel steps from the initial position along a first sub-path towards a positive orientation of the first direction, and allowing the movable area to move K pixel step or steps to the first position along a second sub-path towards a negative orientation of the first direction, wherein J>K≥1, and the first sub-path and the second sub-path partially overlaps.

18. An image drive device, comprising:

a processor; and a nonvolatile storage medium, in which computer instructions applicable to be executed by a processor are stored on the storage medium; and when the computer instructions are executed by the processor, a method applicable to an image display device is implemented, and the method comprises:

selecting at least a partial area in an image display area as a movable area;

allowing the movable area to move M pixel step or steps from an initial position to a first position along a first direction; and allowing the movable area to move N pixel step or steps from the first position to a second position along a second direction, wherein the first direction is intersected with the second direction, M≥1 and N≥1;

allowing of the movable area to move M pixel step or steps from the initial position to the first position along the first direction comprises conducting a following operation at least one time:

allowing the movable area to move J pixel steps from the initial position along a first sub-path towards a positive orientation of the first direction, and allowing the movable area to move K pixel step or steps to the first position along a second sub-path towards a negative orientation of the first direction, wherein J>K≥1, and the first sub-path and the second sub-path partially overlaps.

19. A display device, comprising the image drive device according to claim 18.

20. The image display method according to claim 1, after allowing of the movable area to move N pixel step or steps along the second direction, further comprising:

allowing the movable area to move L pixel step or steps from the second position along a third direction, in which the third direction is different from the second direction and the first direction, and L≥1.

* * * * *